US007804468B2

(12) United States Patent
Park et al.

(10) Patent No.: US 7,804,468 B2
(45) Date of Patent: Sep. 28, 2010

(54) DATA DRIVER SYSTEM AND METHOD, FOR USE WITH A DISPLAY DEVICE, HAVING IMPROVED PERFORMANCE CHARACTERISTICS

(75) Inventors: Yong Sung Park, Seoul (KR); Oh Kyong Kwon, Seoul (KR); Han Jin Bae, Masan (KR); Joon Ho Bae, Seoul (KR); Byong Deok Choi, Seoul (KR)

(73) Assignees: Samsung Mobile Display Co., Ltd., Yongin-si (KR); IUCF-HYU (Industry-University Cooperation Foundation Hanyang University), Seoul (KR)

( * ) Notice: Subject to any disclaimer, the term of this patent is extended or adjusted under 35 U.S.C. 154(b) by 926 days.

(21) Appl. No.: 11/491,270

(22) Filed: Jul. 21, 2006

(65) Prior Publication Data

US 2007/0090347 A1 Apr. 26, 2007

(30) Foreign Application Priority Data

Oct. 24, 2005 (KR) ..... 10-2005-0100430

(51) Int. Cl.
*G09G 3/30* (2006.01)

(52) U.S. Cl. ..... 345/77; 345/76

(58) Field of Classification Search ..... 345/36, 345/39, 44–46, 74.1–83; 315/169.3; 313/436; 257/40; 341/144
See application file for complete search history.

(56) References Cited

U.S. PATENT DOCUMENTS 6,970,121 B1 * 11/2005 Sun ..... 341/144
7,443,540 B2 * 10/2008 Kasai et al. ..... 358/3.01

FOREIGN PATENT DOCUMENTS

KR 10-0520827 10/2005

OTHER PUBLICATIONS

Patent Abstract of Korean, Publication 1020040110931A, Published Dec. 31, 2004, in the name of Park.
Bae, Han-Jin, et al., IMID '05 Digest, Current Uniformity Enhancement for AMOLED Data Driver IC, pp. 1436-1439, 2005.

* cited by examiner

*Primary Examiner*—Chanh Nguyen
*Assistant Examiner*—Ram A Mistry
(74) *Attorney, Agent, or Firm*—Christie, Parker & Hale, LLP

(57) ABSTRACT

A data driver and a method of driving the same. The data driver includes a shift register for generating sampling signals; sampling latches for sampling digital data applied to output channels, respectively, in accordance with the sampling signals; holding latch units for receiving the sampled digital data of the channels from the sampling latches to hold the digital data for a first period; first digital-to-analog converters for receiving the held digital data of the channels from the holding latch units to generate currents corresponding to the digital data; a second digital-to-analog converter commonly connected to the channels and the first digital-to-analog converters to receive the digital data provided from the holding latch units for a second period and to generate correction currents for the data currents; and output stages for sampling, correcting, and driving final currents using the data currents and the correction currents.

20 Claims, 4 Drawing Sheets

DATA DRIVER SYSTEM AND METHOD, FOR USE WITH A DISPLAY DEVICE, HAVING IMPROVED PERFORMANCE CHARACTERISTICS

CROSS-REFERENCE TO RELATED APPLICATION

This application claims priority to and the benefit of Korean Patent Application No. 10-2005-0100430, filed on Oct. 24, 2005, in the Korean Intellectual Property Office, the entire content of which is incorporated herein by reference.

BACKGROUND

1. Field of the Invention

The present invention relates to a data driver, and more particularly, to a data driver included in a current driving (or writing) type organic light emitting display device and a method of driving the same.

2. Discussion of Related Art

An active matrix organic light emitting display (AMOLED) device can be either a voltage driving (or writing) type organic light emitting display device using a voltage writing method to write a voltage signal in a panel to display a desired image on the panel or a current driving (or writing) type organic light emitting display device using a current writing method to write a current signal in a panel to display a desired image on the panel.

In the voltage writing method, a data driving integrated circuit used for driving a liquid crystal display (LCD) can be used. However, since poly-Si thin film transistors (TFTs) used for manufacturing the AMOLED device have large deviations in threshold voltages and/or mobility, the AMOLED device using the voltage writing method has a problem in providing uniform picture quality.

By contrast, the AMOLED device using the current writing method can concurrently compensate for process deviations in the threshold voltages and mobility of the poly-Si TFTs. However, in order to drive the AMOLED panel using the current writing method, a constant current output data driving integrated circuit is required. Here, the constant output data driving integrated circuit needs to provide output currents having a deviation small enough to make picture quality uniform and also needs to be capable of fully driving the parasitic resistance and parasitic capacitance load of the data lines of the panel.

FIG. 1 is a block diagram illustrating a conventional data driver used for the AMOLED device using the current writing method.

Referring to FIG. 1, the conventional data driver used for the AMOLED device using the current writing method includes a shift register 10, a sampling latch 20, a holding latch 30, a digital-to-analog converter 40, and a current output stage 50.

The shift register 10 sequentially shifts start signals IE in accordance with input clock signals CLK and generates sampling signals to supply the sampling signals to the sampling latch 20. The shift register 10 is composed of registers (for example, D flip-flops) whose number is equal to the number of output channels of the current output stage 50. Also, the shift register 10 can output the sampling signals in both directions (from left to right and from right to left) in accordance with shift direction signals SHL for determining shift directions.

The sampling latch 20 latches digital data (R, G, and B data) applied from the outside to data bus lines in accordance with the sampling signals sequentially supplied from the shift register 10 in response to the start signals IE to store the digital data. The sampling latch 20 is composed of registers (for example, D flip-flops) whose number is equal to the number of output channels of the shift register 10.

The holding latch 30 receives the digital data (R, G, and B data) latched by the sampling latch 20 in accordance with holding start signals DH supplied from the outside to hold the latched digital data (R, G, and B data) for one horizontal line period (or row-line time). The holding latch 30 is composed of registers (for example, D flip-flops) whose number is equal to the number of output channels of the sampling latch 20.

The digital-to-analog converter 40 generates the currents corresponding to the digital data (R, G, and B data) supplied from the holding latch 30 using the currents supplied from a current source (not shown). The digital-to-analog converter 40 supplies the generated currents to the current output stage 50 in accordance with input clock signals SCLK.

The current output stage 50 sequentially samples the currents supplied from the digital-to-analog converter 40 to output the sampled currents.

That is, the conventional data driver used for the AMOLED device using the current writing method generates the currents corresponding to the digital data (R, G, and B data) supplied from the outside to output the currents to the outside through output channels Co1 to Con.

FIG. 2 is a block diagram schematically illustrating an example of the digital-to-analog converter 40 illustrated in FIG. 1.

Referring to FIGS. 1 and 2, the digital-to-analog converter 40 includes a decoder 42 and a digital-to-analog conversion (DAC) core 44.

The decoder 42 decodes the held digital data (R, G, and B data) supplied from the holding latch 30 to supply the decoded digital data (R, G, and B data) to the DAC core 44.

The DAC core 44 generates the currents $I_{DAC}$ corresponding to the decoded digital data (R, G, and B data) supplied from the decoder 42 to supply the currents $I_{DAC}$ to the current output stage 50. Therefore, the DAC core 44 includes a current source array (not shown) for generating the currents $I_{DAC}$ corresponding to the decoded digital data (R, G, and B data) supplied from the decoder 42 and a DAC bias circuit for supplying reference current to the current source array. The DAC core 44 generates the currents $I_{DAC}$ corresponding to the digital data (R, G, and B data) supplied from the decoder 42 using the reference current generated by the current source array to output the generated currents $I_{DAC}$ to the current output stage 50 in synchronization with the clock signals SCLK supplied from the outside.

In a process of the above conventional data driver where the digital data (R, G, and B data) held by the holding latch 30 are supplied to the decoder 42 of the digital-to-analog converter 40, the characteristics of the output currents $I_{DAC}$ of the digital-to-analog converter 40 deteriorate due to the parasitic resistance and the parasitic capacitance in the digital-to-analog converter 40 and/or the difference in the characteristics of the threshold voltages of transistors of the data driver.

SUMMARY OF THE INVENTION

Accordingly, it is an aspect of the present invention to provide a data driver included in an active matrix organic light emitting display (AMOLED) device using a current writing method and a method of driving the same. The data driver includes a plurality of first digital-to-analog converters and a second digital-to-analog converter. The first digital-to-analog converters are for converting the currents corresponding to the digital data for the channels to output the currents to the channels. The second digital-to-analog converter is commonly connected to the entire channels of the data driver as well as to the first digital-to-analog converters so that current output stages correct the currents corresponding to the digital data to prevent the characteristics of the output currents $I_{DAC}$ for the channels of the data driver from deteriorating.

According to a first embodiment of the present invention, a data driver is provided. The data driver includes a shift register for generating sampling signals; a plurality of sampling latches for sampling digital data applied to a plurality of output channels, respectively, in accordance with the sampling signals; a plurality of holding latch units for receiving the sampled digital data of the channels from the sampling latches to hold the digital data for a first period; a plurality of first digital-to-analog converters for receiving the held digital data of the channels from the holding latch units to generate data currents corresponding to the digital data; a second digital-to-analog converter commonly connected to the output channels and the first digital-to-analog converters to receive the digital data provided from the holding latch units for a second period and to generate correction currents for the data currents; and a plurality of current output stages for sampling, correcting, and driving final currents corresponding to the digital data applied to the output channels, respectively, using the data currents and the correction currents.

According to a second embodiment of the present invention, a method of driving a data driver is provided. The method includes generating sampling signals; sampling digital data applied to a plurality of output channels, respectively, in accordance with the sampling signals; receiving the sampled digital data of the channels to hold the received digital data for a first period; receiving the held digital data of the channels to generate data currents corresponding to the digital data; receiving the held digital data of the channels for a second period to generate correction currents for the data currents; and sampling, correcting, and driving final currents corresponding to digital data applied to the output channels, respectively, using the data currents and the correction currents.

According to a third embodiment of the present invention, a light emitting display device is provided. The light emitting display device includes an display region including a plurality of pixels in regions defined by a plurality of data lines and a plurality of scan lines; a scan driver for supplying scan signals to the scan lines; and a data driver for generating data signals corresponding to external digital data to supply the data signals to the data lines. The data driver includes a shift register for generating sampling signals; a plurality of sampling latches for sampling digital data applied to a plurality of output channels, respectively, in accordance with the sampling signals; a plurality of holding latch units for receiving the sampled digital data of the channels from the sampling latches to hold the digital data for a first period; a plurality of first digital-to-analog converters for receiving the held digital data of the channels from the holding latch units to generate data currents corresponding to the digital data; a second digital-to-analog converter commonly connected to the output channels and the first digital-to-analog converters to receive the digital data provided from the holding latch units for a second period and to generate correction currents for the data currents; and a plurality of current output stages for sampling, correcting, and driving final currents corresponding to the digital data applied to the output channels, respectively, using the data currents and the correction currents.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
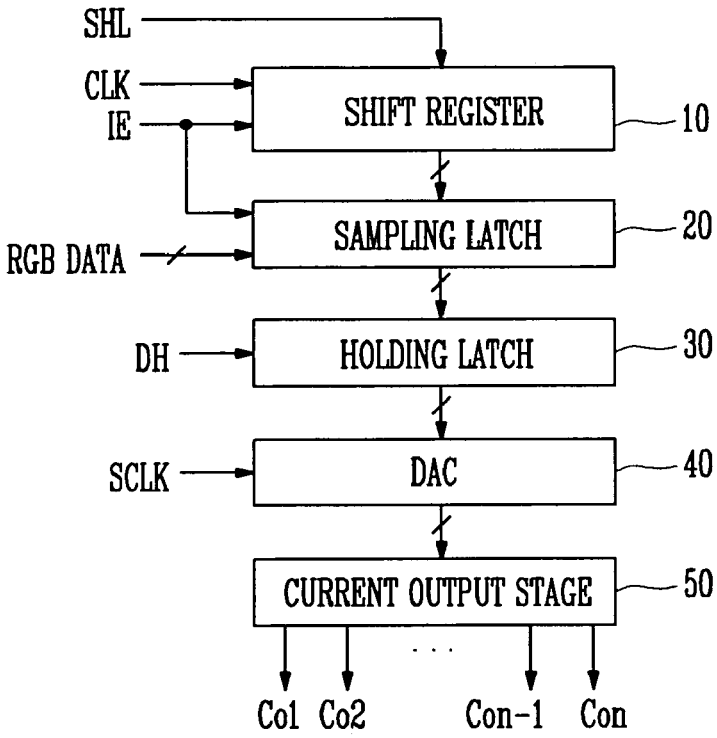
FIG. 1 (PRIOR ART)
FIG. 1 is a block diagram illustrating a conventional data driver used for an active matrix organic light emitting display (AMOLED) device using a current writing method.
Figure 2:
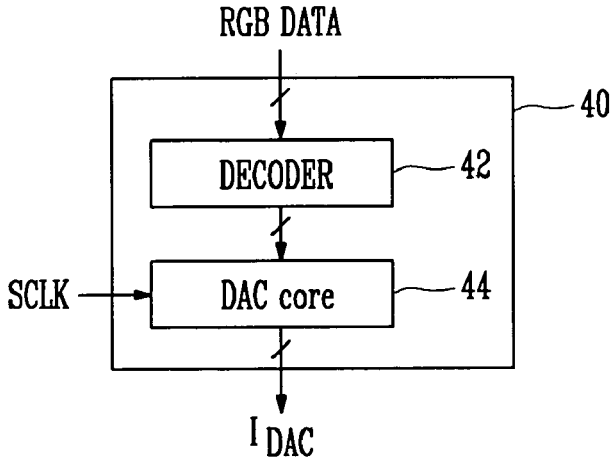
FIG. 2 (PRIOR ART)
FIG. 2 is a block diagram schematically illustrating an example of a digital-to-analog converter illustrated in FIG. 1.

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. Like reference numerals designate like elements. Here, when a first element is connected to/with a second element, the first element may be directly connected to/with the second element, or may be indirectly connected to/with the second element via a third element.

Figure 3:
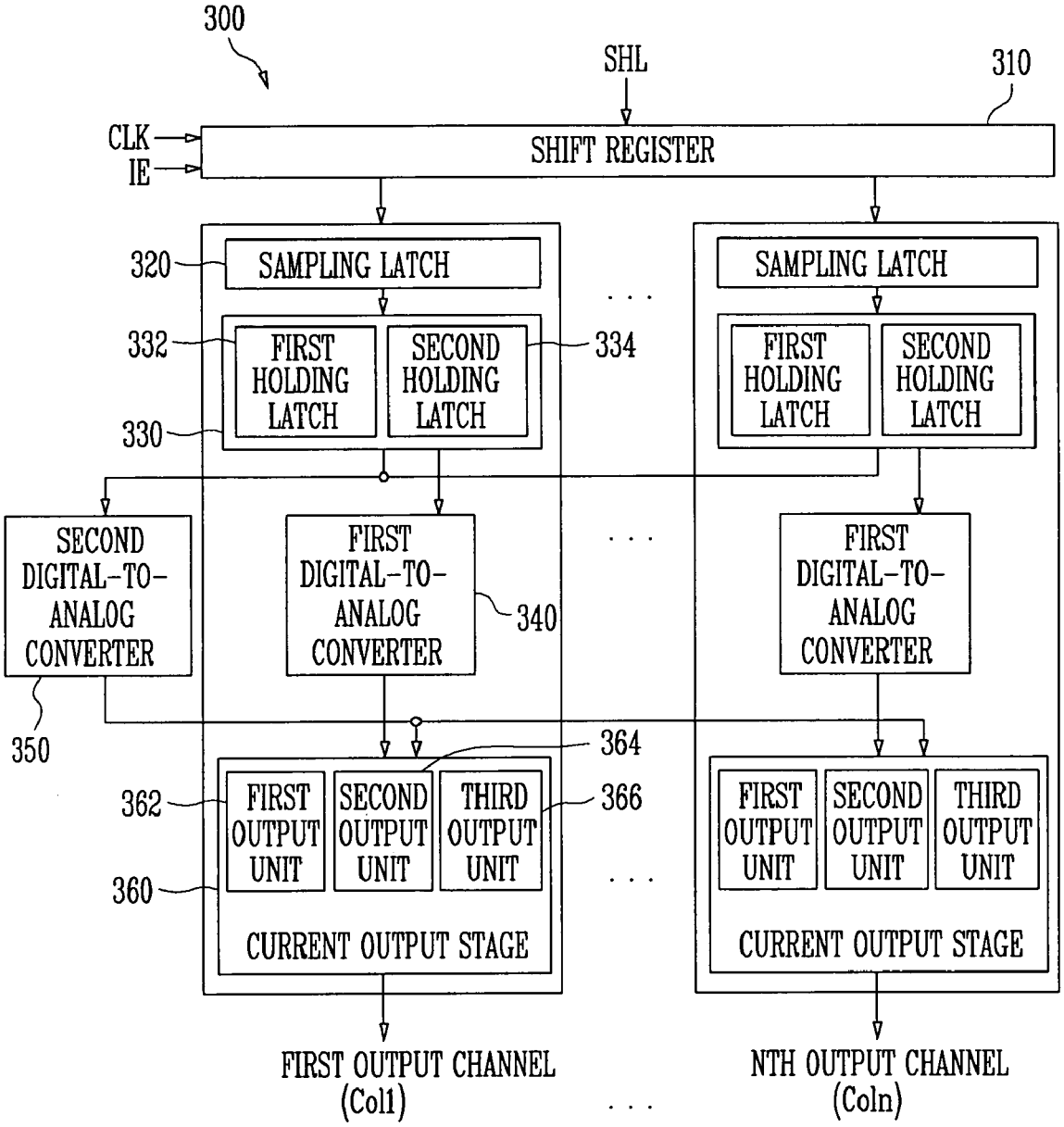
FIG. 3 is a block diagram illustrating a structure of a data driver according to an embodiment of the present invention.

FIG. 3 is a block diagram illustrating a structure of a data driver 300 according to an embodiment of the present invention, which can be used for an active matrix organic light emitting display (AMOLED) device using a current writing method.

Referring to FIG. 3, the data driver 300 includes a shift register 310, a plurality of output channels each including a sampling latch 320, a holding latch unit 330, a first digital-to-analog converter 340, and a current output stage 360; and a second digital-to-analog converter 350 commonly connected to the output channels.

That is, the data driver 300 of FIG. 3 includes the plurality of first digital-to-analog converters 340 and the second digital-to-analog converter 350. The second digital-to-analog converter 350 is commonly connected to the entire channels to output correction currents (which may be predetermined) to the channels as well as connected to the first digital-to-analog converters 340 for outputting the data currents corresponding to the digital data for the channels to the channels so that the current output stages 360 sample and correct the data currents to prevent the characteristics of the output currents $I_{DAC}$ for the output channels of the data driver from deteriorating.

The shift register 310 sequentially shifts start signals IE in accordance with input clock signals CLK to generate sampling signals and to supply the sampling signals to the sampling latches 320 included in the channels, respectively. The shift register 310 may be composed of registers (for example, D flip-flops) whose number is equal to the number of output channels of the current output stages 360. The shift register 310 may output the sampling signals in both directions (from left to right and from right to left) in accordance with shift direction signals SHL for determining shift directions.

The sampling latches 320 included in the output channels, respectively, latch digital data (e.g., R, G, and B data) applied from the outside to data bus lines in accordance with the sampling signals sequentially supplied from the shift register 310 in response to the start signals IE to store the latched digital data (e.g., R, G, and B data).

That is, the sampling latches 320 included in the output channels, respectively, latch the digital data applied to the channels, respectively, to store the latched digital data.

The holding latch units 330 included in the output channels, respectively, receive the digital data (e.g., R, G, and B data) latched in the channels, respectively, from the sampling latches 320 in accordance with the holding start signals (e.g., DH) supplied from the outside to hold the latched digital data (e.g., R, G, and B data) for one horizontal line period (or row-line time).

According to the embodiment of the present invention, the holding latch unit 330 is composed of a pair of holding latches, that is, a first holding latch 332 and a second holding latch 334. When the first holding latches 332 receive the digital data latched in the channels, respectively, from the sampling latches 320 for an ith horizontal line period to hold the latched digital data, the second holding latches 334 receive the latched digital data from the sampling latches 320 for an (i+1)th horizontal line period to hold the latched digital data.

That is, the holding latch units 330 include the first and second holding latches 332 and 334 in the output channels, respectively, to alternately hold the digital data for continuous horizontal line periods.

The first digital-to-analog converters 340 included in the output channels, respectively, receive the digital data (e.g., R, G, and B data) held for a horizontal period (which may be predetermined), that is, a jth horizontal period from the first holding latches 332 or the second holding latches 334 using the current supplied from a current source (not shown) to generate the data currents corresponding to the digital data (e.g., R, G, and B data).

The first digital-to-analog converters 340 supply the generated data currents to the current output stages 360 in accordance with input clock signals (e.g., SCLK).

At this point, the data currents do not correctly correspond to the digital data received from the holding latch units 330 due to the parasitic resistance and the parasitic capacitance in the first digital-to-analog converters 340 and/or the difference in the characteristics of the threshold voltages of transistors of the data driver 300.

According to the present invention, in order to correctly correspond the data currents to the digital data received from the holding latch units 330, correction currents are additionally generated by the channels, respectively, through the second digital-to-analog converter 350 to supply the correction currents to the current output stages 360.

Therefore, the second digital-to-analog converter 350 commonly connected to the output channels, respectively, receives the digital data supplied from the first holding latches 332 or the second holding latches 334 included in the channels, respectively, to the first digital-to-analog converters 340 for a time period (which may be predetermined) to generate the correction currents for the data currents using the digital data.

Here, in one embodiment, the period is a predetermined period. The predetermined period is a certain period in a (j+1)th horizontal period. When the number of output channels is n, the predetermined period corresponds to 1/n of the (j+1)th horizontal period.

That is, the second digital-to-analog converter 350 receives the digital data provided to the output channels, respectively, in a period obtained by dividing a horizontal period (which may be predetermined) by the number of output channels to generate the correction currents for the data currents corresponding to the output channels using the digital data and to provide the correction currents to the current output stages included in the output channels, respectively.

The current output stages 360 included in the output channels, respectively, sample and correct the currents corresponding to the digital data provided to the channels, respectively, using the data currents and correction currents supplied from the first and second digital-to-analog converters 340 and 350 to drive the sampled and corrected final currents.

Here, the final currents being driven refer to the final currents that are output through the output channels. However, when the data driver 300 is used for the AMOLED device using the current writing method, the final currents being driven also refer to the final currents that sink through the output channels.

That is, the current output stages included in the data driver 300 according to an embodiment of the present invention sequentially perform sampling, correcting, and driving operations and also perform an output (which may be predetermined) for every horizontal period. Therefore, the current output stages 360 include first output units 362, second output units 364, and third output units 366.

Here, the first to third output units 362, 364, and 366 perform the above-described sampling, correcting, and driving operations so that the operations do not overlap with each other. As a result, the first to third output units are connected to the output channels, respectively, to alternately drive the final currents on which the sampling and correcting operations are performed for every horizontal line period.

Figure 4:
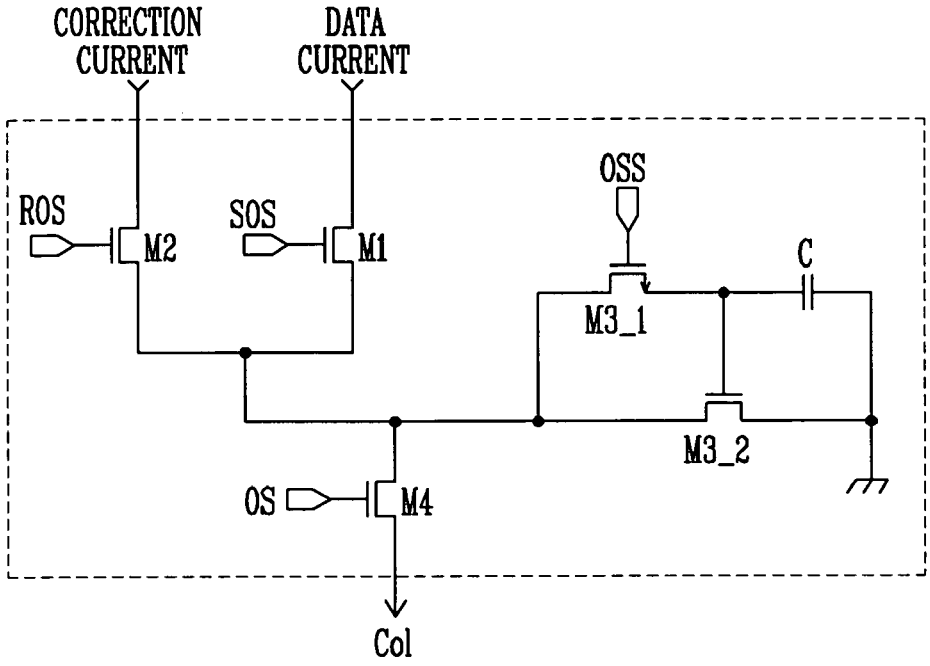
FIG. 4 is a circuit diagram illustrating a first output unit of a current output stage illustrated in FIG. 3.
Figure 5:
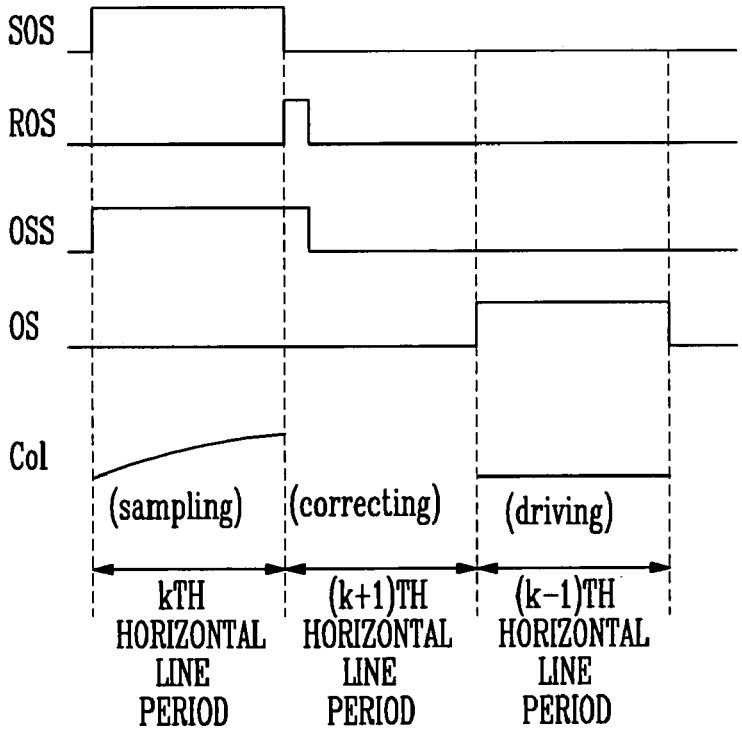
FIG. 5 is a timing diagram of signals input to and output from the first output unit illustrated in FIG. 3.

FIG. 4 is a circuit diagram of a first output unit (e.g., 362) of a current output stage (e.g., 360) illustrated in FIG. 3. FIG. 5 is a timing diagram of signals input to and output from the first output unit illustrated in FIG. 3.

Since the structures and operations of second and third output units (e.g., 364 and 366) of the current output stage are substantially the same as the structure and operation of the first output unit, a description of the structures and operations of the second and third output units will not be provided again in more detail.

Referring to FIG. 4, the first output unit includes a first switch device M1 that receives data current from a corresponding one of a plurality of first digital-to-analog converters (e.g., 340), a second switch device M2 that receives correction current for the data current from a second digital-to-analog converter (e.g., 350), a third switch device unit M3_1 and M3_2 that operates to store the data current and the correction current that is received when the first switch device M1 or the second switch device M2 is turned on for a period (which may be predetermined), a capacitor C for storing the data current and the correction current, and a fourth switch device M4 that receives the stored data current and the correction current to output the stored data current and the correction current.

The third switch device unit M3_1 and M3_2 includes a 3_1th switch device (or a fifth switch device) M3_1 and a 3_2th switch device (or a sixth switch device) M3_2. The gate terminal and the source terminal of the 3_2th switch device M3_2 are connected to the drain terminal and the source terminal of the 3_1th switch device M3_1, respectively. When the 3_1th switch device M3_1 is turned on, the 3_1th switch device M3_1 and the 3_2th switch device M3_2 are connected to each other so that the 3_1th switch device M3_1 and the 3_2th switch device M3_2 operate as a diode (or so that the gate terminal and the source terminal of the 3_2th switch device M3_2 are electrically connected with each other).

Here, the first, second, and fourth switch devices and the third switch device unit can be realized as NMOS transistors as illustrated in FIG. 4, but the present invention is not limited thereto.

Referring to FIGS. 4 and 5, an operation of the first output unit of the current output stage will be described in more detail as follows.

First, when a first signal SOS (e.g., at a high level) is applied to the gate terminal of the first switch device M1 for a horizontal period (which may be predetermined), for example, for a kth horizontal period so that the first switch device M1 is turned on, the data current is received from the first digital-to-analog converter through the source terminal of the first switch device M1.

When a second signal ROS is applied to the gate terminal of the second switch device M2 for a first period (which may be predetermined) in a (k+1)th horizontal period so that the second switch device M2 is turned on, correction current is received from the second digital-to-analog converter through the source terminal of the second switch device M2.

A third signal OSS is applied to the gate terminal of the 3_1th switch device M3_1 in a second period where the first signal SOS or the second signal ROS is applied so that the 3_1th switch device M3_1 is turned on. Therefore, the 3_1th and 3_2th switch devices M3_1 and M3_2 are connected to each other so that the 3_1th and 3_2th switch devices M3_1 and M3_2 operate as a diode. As a result, the data current received through the first switch device M1 and the correction current received through the second switch device M2 are stored in the capacitor connected to the drain terminals of the 3_1th and 3_2th switch devices M3_1 and M3_2.

That is, the data current is stored in the capacitor C so that the sampling operation is performed and the correction current is stored in the capacitor C so that the correcting operation is performed.

Here, the sampling operation is performed in the kth horizontal line period and the correcting operation is performed in the first period in the (k+1)th horizontal line period.

Also, the first period corresponds to 1/n of the (k+1)th horizontal period when the number of output channels is n.

That is, the correction current generated by the second digital-to-analog converter is provided to the first output units of the current output stages included in the output channels, respectively, for a period obtained by dividing a horizontal period (which may be predetermined) by the number of output channels.

As described above, the first switch device M1 and the third switch device unit M3_1 and M3_2 are turned on so that the sampling operation on the data current is performed and the second switch device M2 and the third switch device unit M3_1 and M3_2 are turned on so that the correcting operation on the data current is performed.

When the sampling and correcting operations are performed, a fourth switch device is turned on in a (k+2)th horizontal line so that the current on which the sampling and correcting operations are performed is finally driven through the output channels.

Therefore, the data driver according to the present embodiment generates the currents that correctly correspond to the digital data (e.g., R, G, and B data) supplied from the outside to output the generated currents to the outside through the output channels Co1 to Con.

Here, the final currents being driven refer to the final currents that are output through the output channels. However, when the data driver (e.g., 300) according to the embodiment of the present invention is used for the AMOLED device using the current writing method, the final currents being driven also refer to the final currents that sink through the output channels.

As a result, the first to third output units that constitute one of the current output stages sequentially perform the above-described sampling, correcting, and driving operations so that the operations of the output units do not overlap with each other. The current output stages each having the first to third output units are connected to the output channels, respectively, so that the final currents on which the sampling and correcting operations are performed are alternately driven for every horizontal line.

Figure 6:
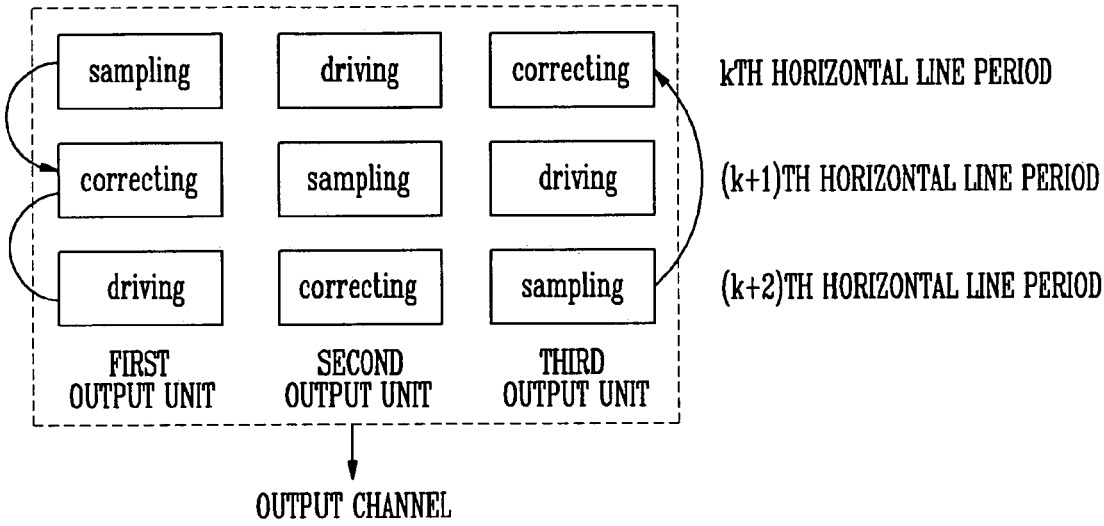
FIG. 6 illustrates operation states of the first output unit, a second output unit, and a third output unit of the current output stage illustrated in FIG. 3.

FIG. 6 illustrates the operation states of the first to third output units of the current output stage illustrated in FIG. 3.

As illustrated in FIG. 6, the first to third output units sequentially perform the sampling, correcting, and driving operations so that the operations of the output units do not overlap with each other in the same horizontal line period.

That is, in the kth horizontal line period, the first output unit performs the sampling operation, the second output unit performs the driving operation, and the third output unit performs the correcting operation. In the (k+1)th horizontal line, the first output unit performs the correcting operation, the second output unit performs the sampling operation, and the third output unit performs the driving operation. In the (k+2)th horizontal period, the first output unit performs the driving operation, the second output unit performs the correcting operation, and the third output unit performs the sampling operation.

In the kth horizontal line period, the second output unit is connected to the output channels to output the final currents. In the (k+1)th horizontal line period, the third output unit is connected to the output channels to output the final currents. In the (k+2)th horizontal line period, the first output unit is connected to the output channels to output the final currents.

Figure 7:
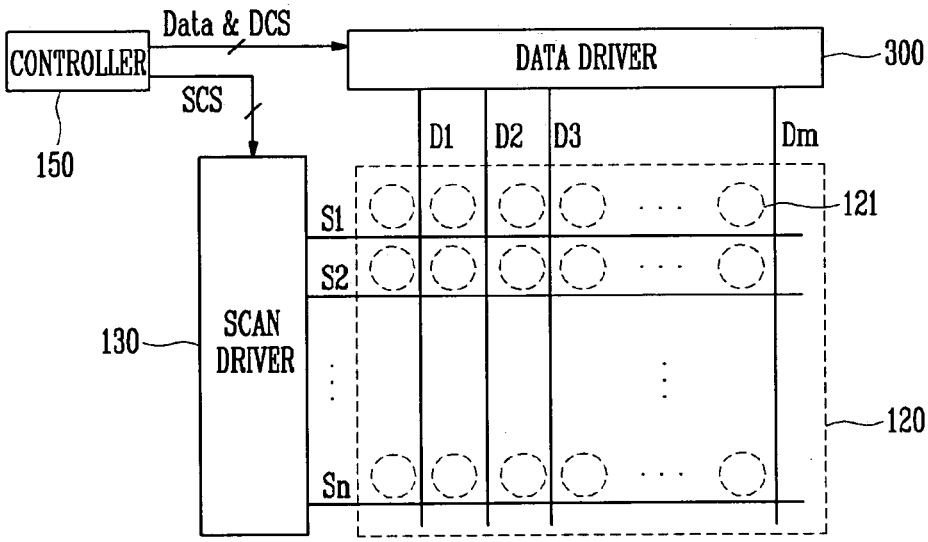
FIG. 7 is a block diagram illustrating a light emitting display including the data driver illustrated in FIG. 3.

FIG. 7 is a block diagram illustrating a light emitting display including the data driver 300 illustrated in FIG. 3.

Referring to FIG. 7, the light emitting display according to the embodiment of the present invention includes a display region (or an image display unit) 120, a scan driver 130, the data driver 300, and a controller 150. Since the data driver 300 was described with reference to FIGS. 3 to 6, a detailed description thereof will not be provided again.

The display region 120 includes a plurality of pixels 121 formed in regions defined by a plurality of scan lines S1 to Sn and a plurality of data lines D1 to Dm. The pixels 121 include electroluminescent devices that emit light by the currents corresponding to the data signals supplied to the data lines D1 to Dm, respectively. Here, the electroluminescent devices may be organic light emitting diodes (OLED). An OLED includes an emitting layer (EML), an electron transport layer (ETL), and a hole transport layer (HTL) formed of organic material between an anode electrode and a cathode electrode. The OLED may further include an electron injection layer (EIL) and a hole injection layer (HIL). In the OLED, when a voltage is applied between the anode electrode and the cathode electrode, the electrons generated by the cathode electrode move toward the EML through the EIL and the ETL and the holes generated by the anode electrode move toward the EML through the HIL and the HTL. Therefore, in the EML, the electrons and the holes supplied from the ETL and the HTL collide with each other to be re-combined with each other so that light is generated.

The display region 120 emits light from the OLEDs of the pixels 121 selected in accordance with the data signals supplied to the data lines D1 to Dm when the scan lines S1 to Sn are sequentially selected to display an image.

The controller 150 aligns the data signal Data supplied from the outside to be suitable for the driving of the display region 120 to supply the data signals Data to the data driver 300. Also, the controller 150 controls the driving of the scan driver 130 and the data driver 300.

The scan driver 130 generates scan signals for sequentially driving the scan lines S1 to Sn in response to the scan control signals SCS supplied from the controller 150, that is, start pulses and clock signals to sequentially supply the scan signals to the scan lines S1 to Sn.

The data driver 300 supplies the data signals Data from the controller 150 to the data lines D in response to the data control signals DCS supplied from the controller 150. Here, the data driver 300 may be mounted on a substrate including the display region 120 or may be provided outside the substrate.

In view of the above, a data driver according to embodiments of the present invention includes a plurality of first digital-to-analog converters and a second digital-to-analog converter. The second digital-to-analog converter is commonly connected to the entire channels as well as to the first digital-to-analog converters for converting the currents corresponding to the digital data for the channels to output the converted currents to the channels, respectively, so that the current output stages correct the currents corresponding to the digital data to prevent the characteristics of the output currents $I_{DAC}$ for the channels of the data driver from deteriorating.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A data driver comprising:

a shift register for generating sampling signals;

a plurality of output channels, each output channel comprising:

a sampling latch for sampling digital data received from a plurality of data channels, respectively, in accordance with the sampling signals;

a plurality of holding latch units for receiving file sampled digital data from the sampling latch to hold the digital data for a first period; and a first digital-to-analog converter for receiving the held digital data from the holding latch units to generate data currents corresponding to the digital data; and a second digital-to-analog converter commonly coupled to at least one of the plurality of holding latch units of each output channel for receiving the digital data provided from the at least one of the plurality of holding latch units for a second period and for generating correction currents for the data currents, wherein each output channel further comprises a plurality of current output stages for sampling, correcting, and driving final currents corresponding to the digital data received from the data channels, respectively, using the data currents and the correction currents, and wherein the second digital-to-analog converter is coupled in parallel with the plurality of first digital-to-analog converters.

2. The data driver as claimed in claim 1, wherein each of the holding latch units comprises a first holding latch and a second holding latch to alternately hold the digital data received from the data channels for continuous horizontal line periods.

3. The data driver as claimed in claim 1, wherein the second period is obtained by dividing a horizontal period by a number equal to the number of the output channels.

4. The data driver as claimed in claim 1, wherein each of the current output stages comprises a first output unit, a second output unit, and a third output unit.

5. The data driver as claimed in claim 4, wherein each of the first, second, and third output units comprises:

a first switch device for receiving one of the data currents from one of the first digital-to-analog converters;

a second switch device for receiving one of the correction currents for the one of the data currents from the second digital-to-analog converter;

a third switch device unit for storing the one of the data currents received when the first switch device is turned on for a third period and the one of the correction currents received when the second switch device is turned on for a fourth period;

a capacitor for storing the one of the data currents and the one of the correction currents; and a fourth switch device for receiving and outputting the stored data current and the stored correction current.

6. The data driver as claimed in claim 5, wherein the third switch device unit comprises a fifth switch device and a sixth switch device.

7. The data driver as claimed in claim 6, wherein a gate terminal and a source terminal of the sixth switch device are connected to a drain terminal and a source terminal of the fifth switch device, respectively, so that, when the fifth switch device is turned on, the fifth switch device and the sixth switch device are connected to each other to operate as a diode.

8. The data driver as claimed in claim 4, wherein the first, second, and third output units sequentially perform a sampling operation, a correcting operation, and a driving operation so that the sampling, correcting, and driving operations of the first, second, and third output units do not overlap with each other in a same horizontal line period.

9. The data driver as claimed in claim 4, wherein the first, second, and third output units of each output stage are connected to the output channels, respectively, to alternatively drive final currents on which sampling and correcting operations are performed to the output channels for every horizontal line period.

10. The data driver as claimed in claim 9, wherein the final currents being driven are the final currents output through the output channels or the final currents sinked through the output channels.

11. A method of driving a data driver, the method comprising:

generating sampling signals;

sampling digital data received from a plurality of data channels, respectively, in accordance with the sampling signals;

receiving, at a plurality of holding latch units, the sampled digital data to hold the received digital data for a first period;

receiving, at a plurality of first digital-to-analog converters, the held digital data to generate data currents corresponding to the digital data;

receiving, at a second digital-to-analog converter coupled in parallel with the plurality of first digital-to-analog converters, the held digital data, from the plurality of holding latch units, for a second period to generate correction currents for the data currents; and sampling, correcting, and driving final currents corresponding to digital data received from the data channels, respectively, using the data currents and the correction currents.

12. The method as claimed in claim 11, wherein the second period is obtained by dividing a horizontal period by a number equal to the number of the output channels.

13. The method as claimed in claim 11, wherein the sampling, correcting, and driving of the final currents includes a sampling operation, a correcting operation, and a driving operation, and wherein the sampling, correction, and driving operations are sequentially performed by first, second, and third output units so that the sampling, correcting, and driving operations do not overlap with each other in a same horizontal line period.

14. The method as claimed in claim 13, wherein the first, second, and third output units are connected to the output channels to alternately drive the final currents on which the sampling and correcting operations are performed to the output channels for every horizontal line period.

15. The method as claimed in claim 14, wherein the final currents being driven are the final currents output through output channels or the final currents sinked through the output channels.

16. A light emitting display device comprising:

a display region including a plurality of pixels in regions defined by a plurality of data lines and a plurality of scan lines;

a scan driver for supplying scan signals to the scan lines; and a data driver for generating data signals corresponding to external digital data to supply the data signals to the data lines, wherein the data driver comprises:

a shift register for generating sampling signals;

a plurality of output channels, each output channel comprising:

a sampling latch for sampling digital data received from a plurality of data channels, respectively, in accordance with the sampling signals;

a plurality of holding latch units for receiving file sampled digital data from the sampling latch to hold the digital data for a first period; and a first digital-to-analog converter for receiving the held digital data from the holding latch units to generate data currents corresponding to the digital data; and a second digital-to-analog converter commonly coupled to at least one of the plurality of holding latch units of each output channel for receiving the digital data provided from the at least one of the plurality of holding latch units for a second period and for generating correction currents for the data currents, wherein each output channel further comprises a plurality of current output stages for sampling, correcting, and driving final currents corresponding to the digital data received from the data channels, respectively, using the data currents and the correction currents, and wherein the second digital-to-analog converter is coupled in parallel with the plurality of first digital-to-analog converters.

17. The light emitting display as claimed in claim 16, wherein each of the current output stages comprises a first output unit, a second output unit, and a third output unit.

18. The light emitting display as claimed in claim 17, wherein the first, second, and third output units sequentially perform a sampling operation, a correcting operation, and a driving operation so that the sampling, correcting, and driving operations of the first, second, and third output units do not overlap with each other in a same horizontal line period.

19. The light emitting display as claimed in claim 17, wherein the first, second, and third output units of each output stage are connected to the output channels, respectively, to alternatively drive final currents on which sampling and correcting operations are performed to the output channels for every horizontal line period.

20. The light emitting display as claimed in claim 19, wherein the final currents being driven are the final currents output through the output channels or the final currents sinked through the output channels.

* * * * *

UNITED STATES PATENT AND TRADEMARK OFFICE

CERTIFICATE OF CORRECTION

PATENT NO. : 7,804,468 B2
APPLICATION NO. : 11/491270
DATED : September 28, 2010
INVENTOR(S) : Yong-Sung Park et al.

It is certified that error appears in the above-identified patent and that said Letters Patent is hereby corrected as shown below:

| | |
|---|---|
| Column 9, Claim 1, line 52 | Delete "file"<br>Insert -- the -- |
| Column 10, Claim 9, line 50 | Delete "alternatively"<br>Insert -- alternately -- |
| Column 12, Claim 16, line 4 | Delete "file"<br>Insert -- the -- |
| Column 12, Claim 19, line 38 | Delete "alternatively"<br>Insert -- alternately -- |

Signed and Sealed this
Thirty-first Day of January, 2012

David J. Kappos

David J. Kappos
*Director of the United States Patent and Trademark Office*